US012195291B2

(12) United States Patent
Takashima et al.

(10) Patent No.: US 12,195,291 B2
(45) Date of Patent: Jan. 14, 2025

(54) SHEET CONVEYING DEVICE

(71) Applicant: TOSHIBA TEC KABUSHIKI KAISHA, Tokyo (JP)

(72) Inventors: Kenji Takashima, Numazu Shizuoka (JP); Eizo Kurita, Sunto Shizuoka (JP); Toshiaki Oshiro, Izu Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 138 days.

(21) Appl. No.: 17/943,138

(22) Filed: Sep. 12, 2022

(65) Prior Publication Data

US 2023/0150782 A1 May 18, 2023

(30) Foreign Application Priority Data

Nov. 16, 2021 (JP) ..... 2021-186464

(51) Int. Cl.
*B65H 3/06* (2006.01)
*B65H 1/08* (2006.01)

(52) U.S. Cl.
CPC ..... *B65H 3/0684* (2013.01); *B65H 1/08* (2013.01); *B65H 2402/54* (2013.01); *B65H 2553/41* (2013.01); *B65H 2553/81* (2013.01)

(58) Field of Classification Search
CPC ... B65H 1/04; B65H 1/08; B65H 1/12; B65H 3/0684; B65H 2553/41; B65H 2553/61; B65H 2553/81; B65H 2402/54; B65H 2403/512; B65H 2801/06; G03G 15/6511
See application file for complete search history.

(56) References Cited

U.S. PATENT DOCUMENTS 7,500,664 B2 * 3/2009 Nakashima ..... B65H 3/06 271/157
7,731,171 B2 * 6/2010 Ohishi ..... G03G 15/6511 271/34
8,136,808 B2 * 3/2012 Kimura ..... B65H 1/08 271/127
2023/0159291 A1 * 5/2023 Suzuki ..... B65H 7/02 270/1.01

FOREIGN PATENT DOCUMENTS

JP H06219573 A 8/1994
JP 2009220972 A 10/2009

* cited by examiner

*Primary Examiner* — Leslie A Nicholson, III
(74) *Attorney, Agent, or Firm* — Kim & Stewart LLP

(57) ABSTRACT

According to one embodiment, a sheet conveying device includes a tray, a pickup roller, a movement mechanism, a holder, a biasing unit, and a detecting mechanism. The movement mechanism moves the tray between a raised position and a lowered position. The raised position is a position where sheets come into contact with the pickup roller. The holder holds the pickup roller so that the pickup roller is displaceable when pushed up by the sheets. The biasing unit applies a biasing force to the holder pushing down the pickup roller. The detecting mechanism detects when the sheets push up the pickup roller. The detecting mechanism includes a detection unit and a sensor. The detection unit is switchable between a reference position and a detection position according to displacement of the holder accompanying the movement of the tray. The sensor detects when the detection unit reaches the detection position.

17 Claims, 11 Drawing Sheets

SHEET CONVEYING DEVICE

CROSS-REFERENCE TO RELATED APPLICATION

This application is based upon and claims the benefit of priority from Japanese Patent Application No. 2021-186464, filed Nov. 16, 2021, the entire contents of which are incorporated herein by reference.

FIELD

Embodiments described herein relate to a sheet conveying device such as, for example, a printer or the like.

BACKGROUND

An image processing apparatus includes a sheet conveying device. The sheet conveying device includes a tray on which a plurality of sheets are stacked. The device also has a pickup roller to remove a sheet from the tray and a raising and lowering mechanism that raises a part of the tray. The sheet conveying device may include a detecting mechanism that detects when the tray is raised and when a sheet reaches the pickup roller. In general, sheet conveying device is required to be small in size.

DETAILED DESCRIPTION

Figure 1:
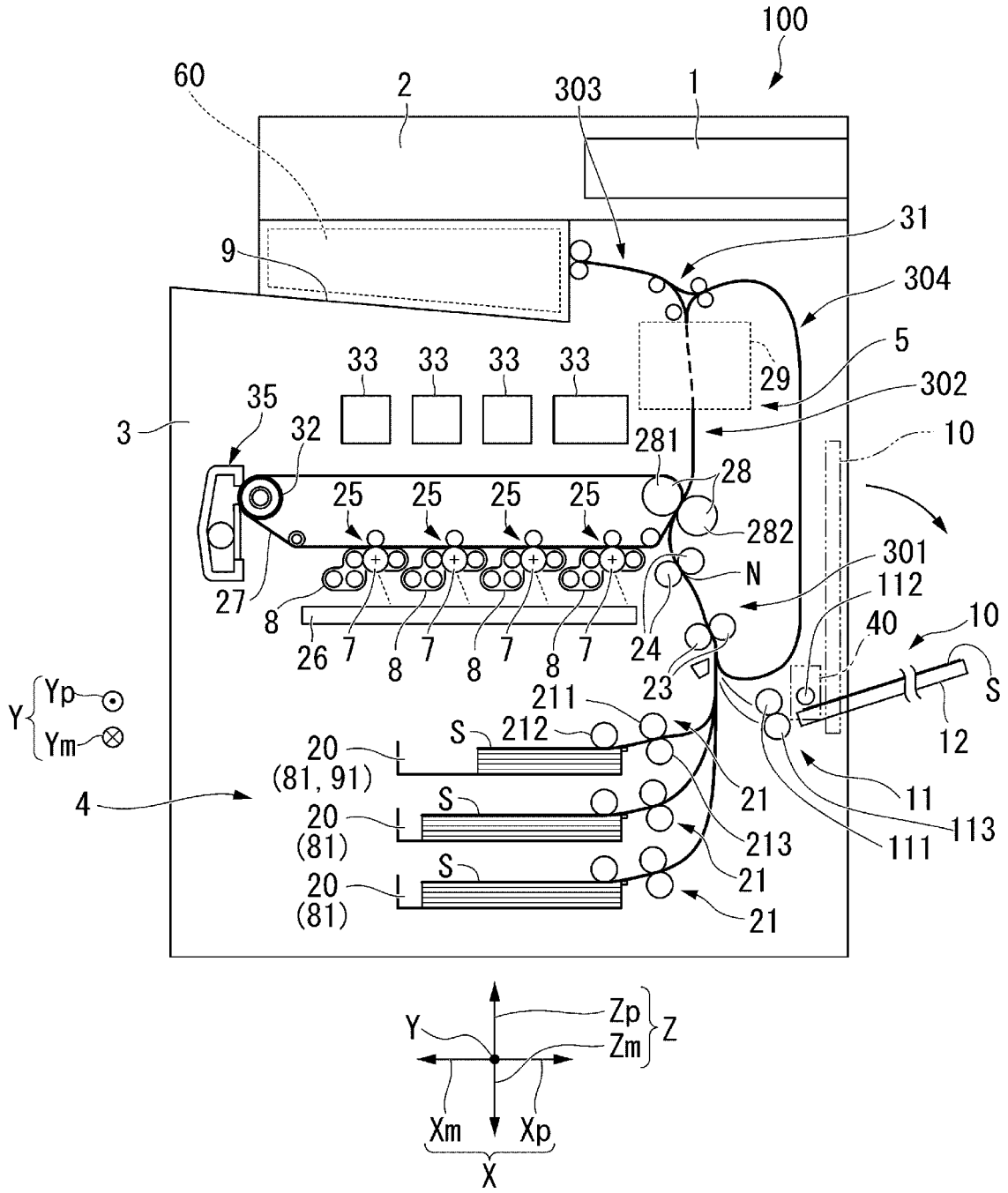
FIG. 1 is a schematic view of an image processing apparatus including a sheet conveying device according to a first embodiment.

According to one embodiment, a sheet conveying device sheet conveying device includes a tray on which sheets can be stacked, a pickup roller configured to convey sheets from the tray to a sheet conveyance path, and a movement mechanism configured to move the tray between a raised position at which sheets on the tray come into contact with the pickup roller and a lowered position that is lower than the raised position. A holder is configured to hold the pickup roller such that the pickup roller displaces upward when pushed up by sheets on the tray. A biasing unit is configured to apply a biasing force to the holder in a direction pushing the pickup roller downward towards the tray. A detecting mechanism is configured to detect when the pickup roller is displaced upward by the sheets on the tray. The detecting mechanism includes a detection unit that moves between a reference position and a detection position according to displacement of the holder upwards or downwards and a sensor that is configured to detect the detection unit at the detection position.

Hereinafter, sheet conveying devices according to certain example embodiments will be described with reference to the drawings. In the drawings, the same or corresponding components are denoted by the same reference numerals unless otherwise specified.

First Embodiment

FIG. 1 is a schematic view showing a configuration example of an image processing apparatus including the sheet conveying device according to the first embodiment.

As shown in FIG. 1, an image processing apparatus 100 includes a control panel 1, a scanner unit 2, a printer unit 3, a sheet feeding unit 4, a conveying unit 5, a manual feeding unit 10 (sheet conveying device), and a control circuit 60.

In the following description, when referring to relative positions in the image processing apparatus 100, an Xp direction, an Xm direction, a Yp direction, a Ym direction, a Zp direction, and a Zm direction shown in the drawing may be used. The Xp direction is a direction from left to right when standing in front of the image processing apparatus 100 (in front of the paper of FIG. 1). The Xm direction is a direction opposite to the Xp direction. The Yp direction is a direction from back to front of the image processing apparatus 100. The Ym direction is a direction opposite to the Yp direction. The Zp direction is a vertically upward direction. The Zm direction is a vertically downward direction.

A plane orthogonal to the X direction is referred to as a YZ plane, a plane orthogonal to the Y direction is referred to as a ZX plane, and a plane orthogonal to the Z direction is referred as an XY plane.

When a user manipulates the control panel 1, the image processing apparatus 100 can be operated.

The scanner unit 2 reads image information from an object to be copied based on brightness and darkness of reflected light. The scanner unit 2 outputs the image information that has been read to the printer unit 3.

The printer unit 3 forms, based on the image information from the scanner unit 2 or the outside, an image on the sheet S.

The printer unit 3 forms an output image (toner image) with a developer containing toner. The printer unit 3 transfers the toner image onto a front surface of the sheet S. The printer unit 3 applies heat and pressure to the toner image on the front surface of the sheet S to fix the toner image on the sheet S.

The sheet feeding unit 4 feeds the sheets S one after one to the printer unit 3 at a timing at which the printer unit 3 forms the toner image.

The sheet feeding unit 4 includes a plurality of sheet feeding cassettes 20 and a plurality of cassette sheet feeding units 21.

The plurality of sheet feeding cassettes 20 stores the sheets S of various sizes. In the example shown in FIG. 1, the three sheet feeding cassettes 20 are provided in three stages.

The plurality of cassette sheet feeding units 21 are disposed above end portions of respective sheet feeding cassettes 20 in the Xp direction. Each of the cassette sheet feeding units 21 includes a pickup roller 212 (conveying roller), a sheet feeding roller 211, and a separation roller 213.

The pickup roller 212 conveys the sheet S for image formation from the sheet feeding cassette 20 to a nip portion between the sheet feeding roller 211 and the separation roller 213. The pickup roller 212 is an example of the conveying roller that conveys sheets S in the conveyance direction from an upper side of the stacked sheets in a sheet feeding cassette 20.

The sheet feeding roller 211 conveys the sheet S conveyed from the nip portion to the conveying unit 5.

The separation roller 213 serves to separate one sheet S from the other sheets when a plurality of sheets S are conveyed at the same time.

The conveying unit 5 includes conveying rollers 23 and registration rollers 24. The conveying unit 5 conveys the sheet S fed from the sheet feeding unit 4 to the registration rollers 2.

The registration rollers 24 convey the sheet S at a timing corresponding to that at which the printer unit 3 transfers the toner image on the sheet S.

The conveying rollers 23 abut a top end (leading edge) of the sheet S in the conveyance direction against a nip N between the registration rollers 24. The conveying rollers 23 adjust a position of the top end of the sheet S in the conveyance direction by bending the sheet S.

The registration rollers 24 align the top end of the sheet S at the nip N. The registration rollers 24 then convey the sheet S to a transferring unit 28.

The conveying unit 5 includes conveyance paths 301, 302, 303, and 304.

The printer unit 3 includes a plurality of image forming units 25, a plurality of exposure units 26, an intermediate transferring belt 27, a transferring unit 28, a fixing device 29, and a transferring belt cleaning unit 35.

Four image forming units 25 are disposed side by side in the Xp direction.

Each of the plurality of image forming units 25 forms a toner image on the intermediate transferring belt 27 to be transferred to the sheet S.

Each of the plurality of image forming units 25 includes a photosensitive drum 7. The plurality of image forming units 25 form yellow, magenta, cyan, and black toner images on respective photosensitive drums 7.

A charger, a developing device 8, a primary transfer roller, a cleaning unit, and a static eliminator are disposed around each of the photosensitive drums 7. The primary transfer roller faces the photosensitive drum 7. The intermediate transferring belt 27 is sandwiched between the primary transfer roller and the photosensitive drum 7. The exposure units 26 are disposed below the chargers and the developing devices 8.

Toner cartridges 33 are disposed above the image forming units 25, respectively. Colors of toner stored in each of the toner cartridges 33 are different. The four toner cartridges 33 in this example store yellow, magenta, cyan, and black toners, respectively.

The toner in each of the toner cartridges 33 is fed to a corresponding one of the lower image forming units 25 by a toner supplying pipe or the like.

The exposure units 26 irradiate surfaces of the charged photosensitive drums 7 with laser light. Emission of the laser light is controlled based on the image information. The exposure units 26 may emit LED light instead of the laser light in some examples. In the example shown in FIG. 1, the exposure units 26 are disposed below the plurality of the image forming units 25.

The image information corresponding to yellow, magenta, cyan, and black color channels is fed to the exposure units 26, respectively.

The exposure units 26 form electrostatic latent images based on the image information on the surfaces of the photosensitive drums 7.

The intermediate transferring belt 27 comprises an endless belt (a loop). Tension is applied to the intermediate transferring belt 27 by a plurality of rollers that abut against an inner circumferential surface of the intermediate transferring belt 27. The intermediate transferring belt 27 is stretched flat. The inner circumferential surface of the intermediate transferring belt 27 abuts against a supporting roller 281 at a position in the Xp direction farthest in a stretching direction. The inner circumferential surface of the intermediate transferring belt 27 abuts against a transferring belt roller 32 at a position in the Xm direction farthest in the stretching direction.

The supporting roller 281 constitutes a part of the transferring unit 28. The supporting roller 281 guides the intermediate transferring belt 27 to a secondary transfer position.

The transferring belt roller 32 guides the intermediate transferring belt 27 to a cleaning position.

On a lower surface side of the intermediate transferring belt 27 shown in the drawing, the image forming units 25 other than the primary transfer rollers are disposed in the Xp direction. The image forming units 25 are disposed at intervals in a region between the transferring belt roller 32 and the supporting roller 281.

When the toner images reach a primary transfer position, a transfer bias is applied to the primary transfer roller of each of the image forming units 25. Each of the primary transfer rollers transfers (primary transfers) the toner image on the surface of a corresponding one of the photosensitive drums 7 to the intermediate transferring belt 27.

In the intermediate transferring belt 27, the transferring unit 28 is disposed at a position closest to the image forming units 25 in the Xp direction.

The transferring unit 28 includes the supporting roller 281 and a secondary transfer roller 282. The intermediate transferring belt 27 is sandwiched between the secondary transfer roller 282 and the supporting roller 281. A position at which the secondary transfer roller 282 abuts against the intermediate transferring belt 27 is referred to as the secondary transfer position.

The transferring unit 28 transfers, onto the front surface of the sheet S, the toner images on the intermediate transferring belt 27 at the secondary transfer position. The transferring unit 28 applies a transfer bias at the secondary transfer position. The transferring unit 28 transfers the toner images on the intermediate transferring belt 27 to the sheet S by application of the transfer bias.

The fixing device 29 applies heat and pressure to the sheet S. The fixing device 29 fixes, by the heat and pressure, the toner images to the sheet S. The fixing device 29 is disposed above the transferring unit 28.

The transferring belt cleaning unit 35 faces the transferring belt roller 32. The transferring belt cleaning unit 35 contacts the intermediate transferring belt 27. The transferring belt cleaning unit 35 scrapes off toner on the surface of the intermediate transferring belt 27.

The conveyance paths 301 and 302 for conveying the sheet S from a lower side to an upper side are formed between the registration rollers 24 and the transferring unit 28 and between the transferring unit 28 and the fixing device 29 in this order. The conveyance path 303 for discharging the sheet S in the horizontal direction is formed between the fixing device 29 and a sheet discharging port.

A conveyance direction switching unit 31 that switches the conveyance direction of the sheet S is provided above the fixing device 29.

The conveyance path 304 for conveying the sheet S from the conveyance direction switching unit 31 back to the registration rollers 24 is formed inside the printer unit 3 on an Xp direction side of the conveyance paths 301 and 302. The conveyance path 304 is used, for example, for reversing the sheet S having an image already formed on the front surface thereof and feeding the sheet S to the registration rollers 24 when duplex (two-sided) printing is performed.

Each of the conveyance paths 301, 302, 303, and 304 includes conveyance guiding portions that face each other with the sheet S passing therebetween, and a conveying roller provided as necessary.

The manual feeding unit 10 can be used to feed sheets S the printer unit 3. The manual feeding unit 10 is an example of the sheet conveying device.

Figure 2:
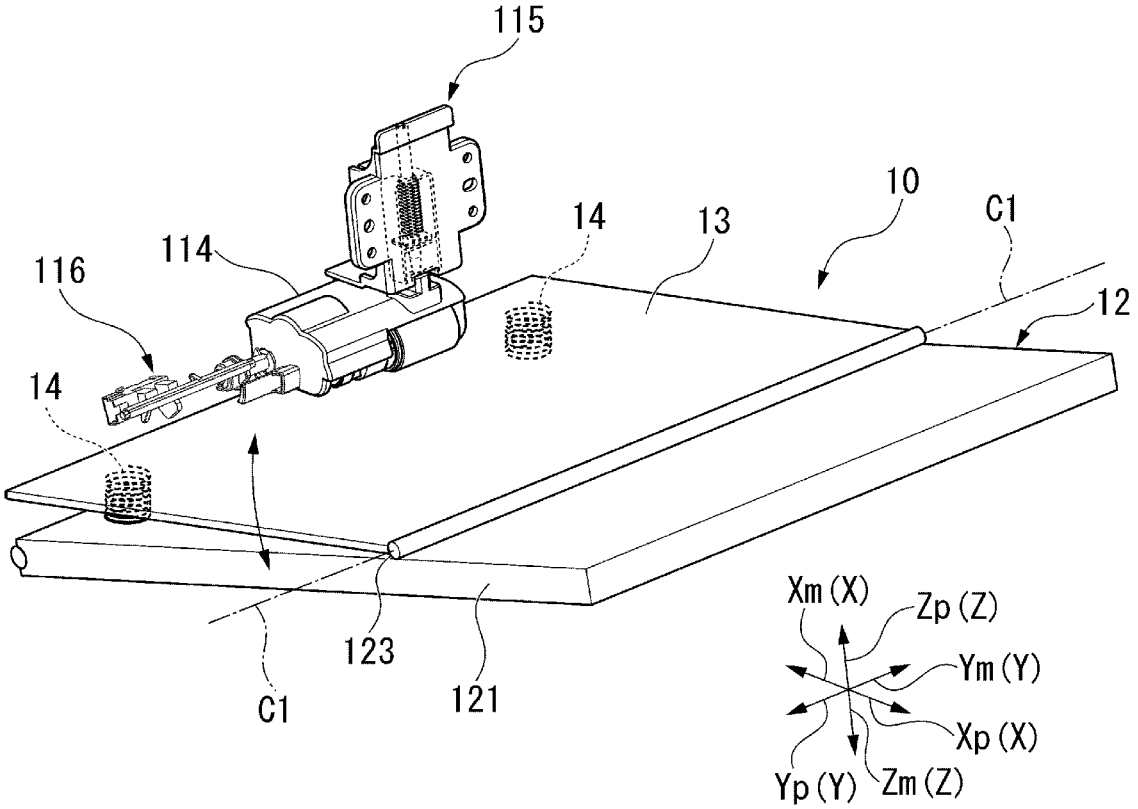
FIG. 2 is a perspective view of a sheet conveying device according to a first embodiment.

The manual feeding unit 10 includes a manual sheet feeding unit 11, a manual feeding tray 12, a raising and lowering mechanism 40, a holder 114 (see FIG. 2), a biasing unit 115 (see FIG. 2), and a tray up detecting mechanism 116 (see FIG. 2).

The manual sheet feeding unit 11 includes a pickup roller 112 (conveying roller), a sheet feeding roller 111, and a separation roller 113. The manual sheet feeding unit 11 separates and feeds the sheets S placed on the manual feeding tray 12, and conveys the sheets S toward the registration rollers 24.

The pickup roller 112 has the same configuration as that of the pickup roller 212 in the cassette sheet feeding unit 21. The sheet feeding roller 111 has the same configuration as that of the sheet feeding roller 211 in the cassette sheet feeding unit 21. The separation roller 113 has the same configuration as that of the separation roller 213 in the cassette sheet feeding unit 21. The pickup roller 112 is an example of a conveying roller that conveys a sheet S in the conveyance direction from an upper surface of a stack or the like.

The manual feeding tray 12 is pivotable around an axis along the Y direction. When the manual feeding tray 12 is to be used the manual feeding tray 12 is pivoted clockwise in FIG. 1 and opened as indicated by the solid line depiction of the manual feeding tray 12. Sheets S of various sizes can be placed on the opened manual feeding tray 12.

When the manual feeding tray 12 is not being used, the manual feeding tray 12 can be pivoted counterclockwise in FIG. 1 and stored in or against a side portion of the printer unit 3, as indicated by a two-dot chain line depiction in FIG. 1.

Figure 3:
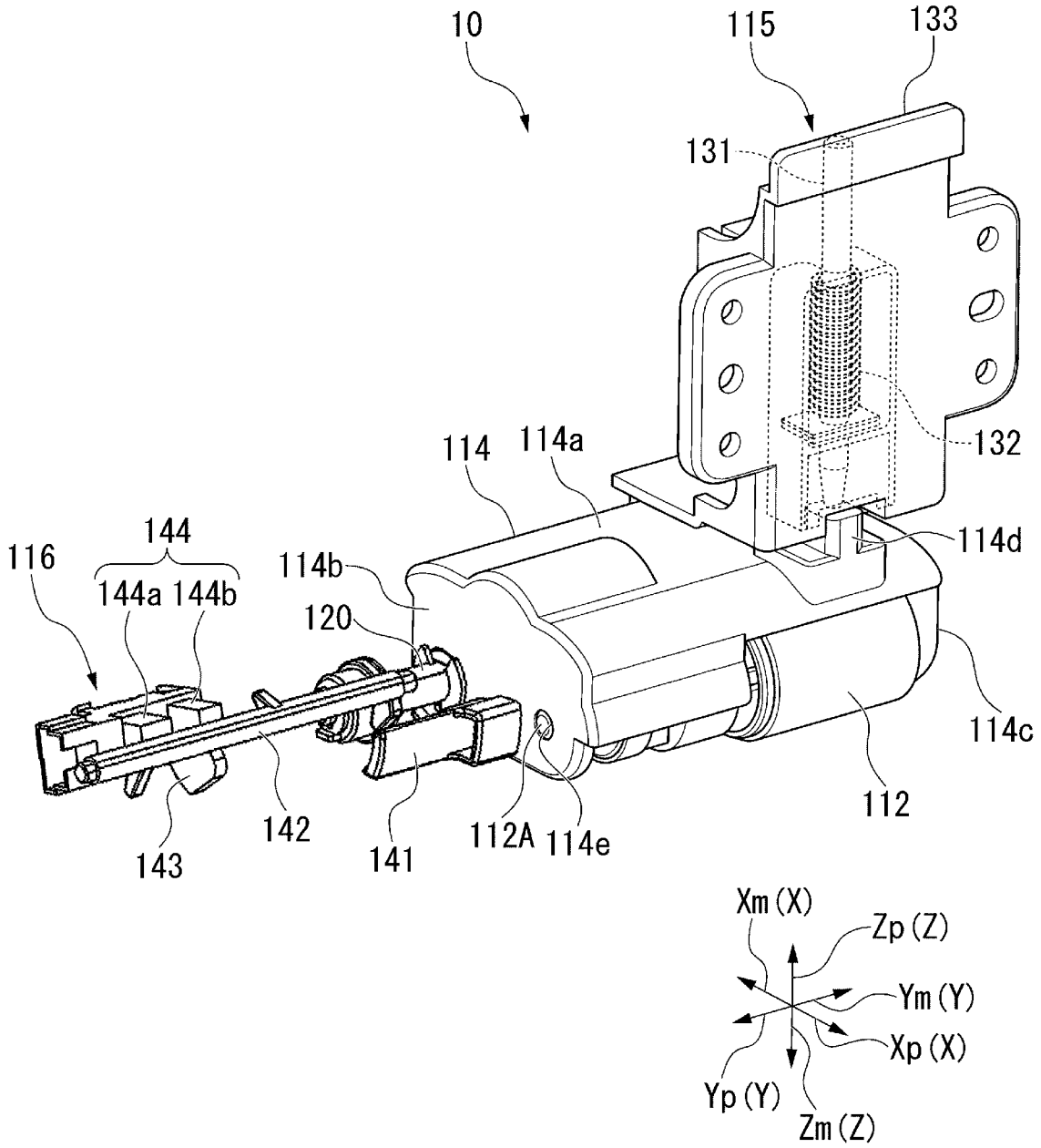
FIG. 3 is a perspective view depicting aspects of a sheet conveying device according to a first embodiment.
Figure 4:
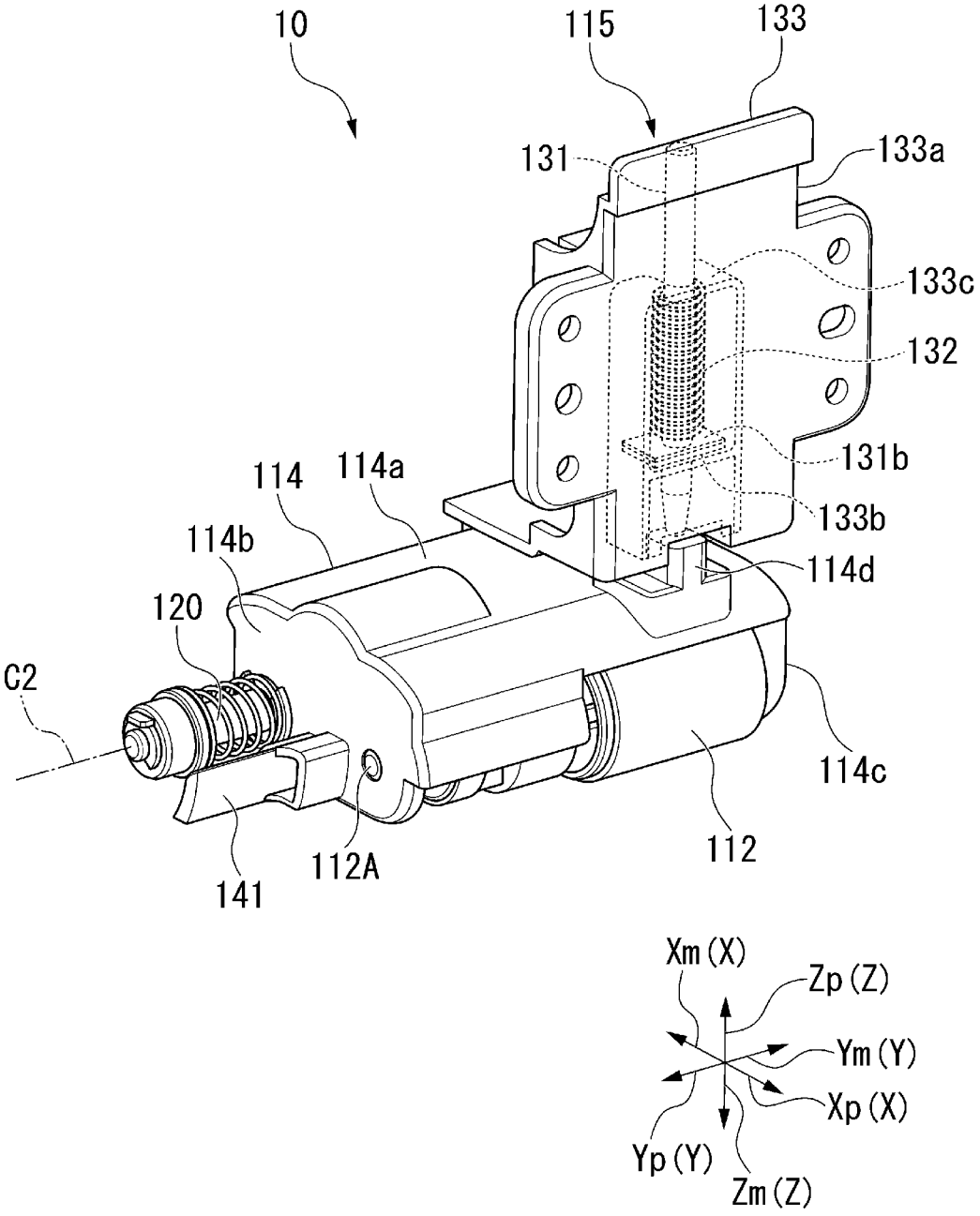
FIG. 4 is a perspective view depicting aspects of a sheet conveying device according to a first embodiment.
Figure 5:
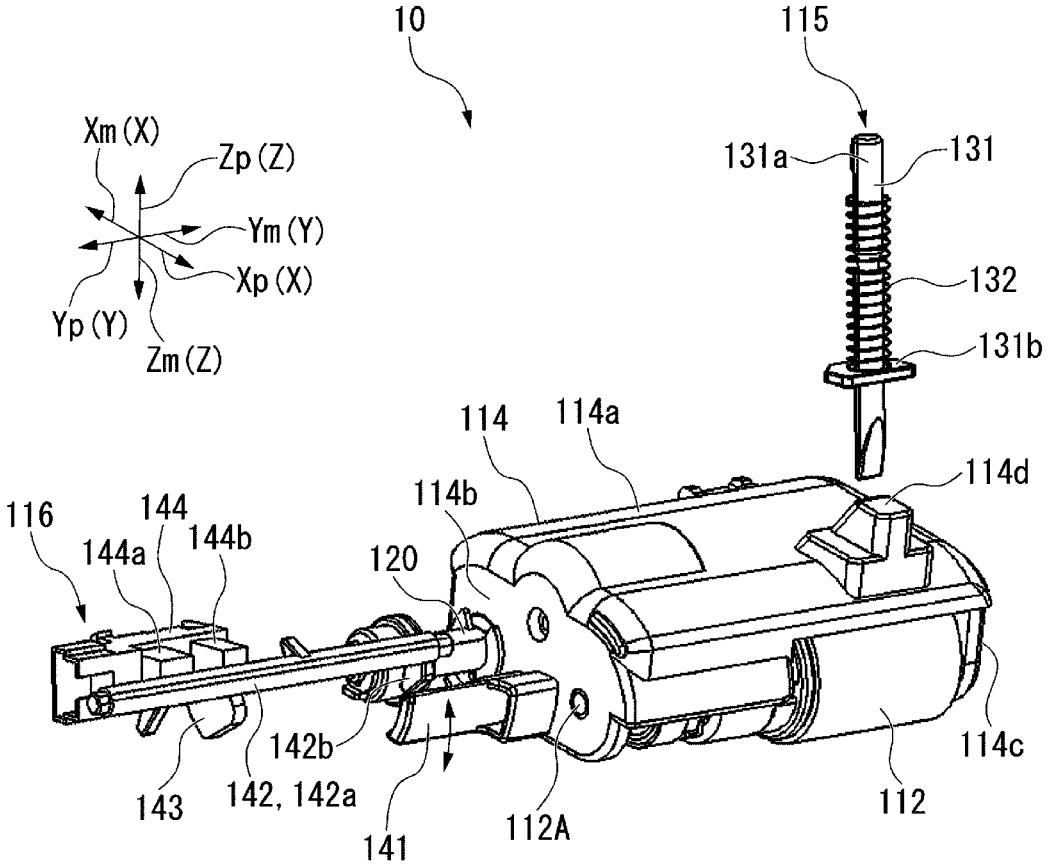
FIG. 5 is a perspective view depicting aspects of a sheet conveying device according to a first embodiment.
Figure 6:
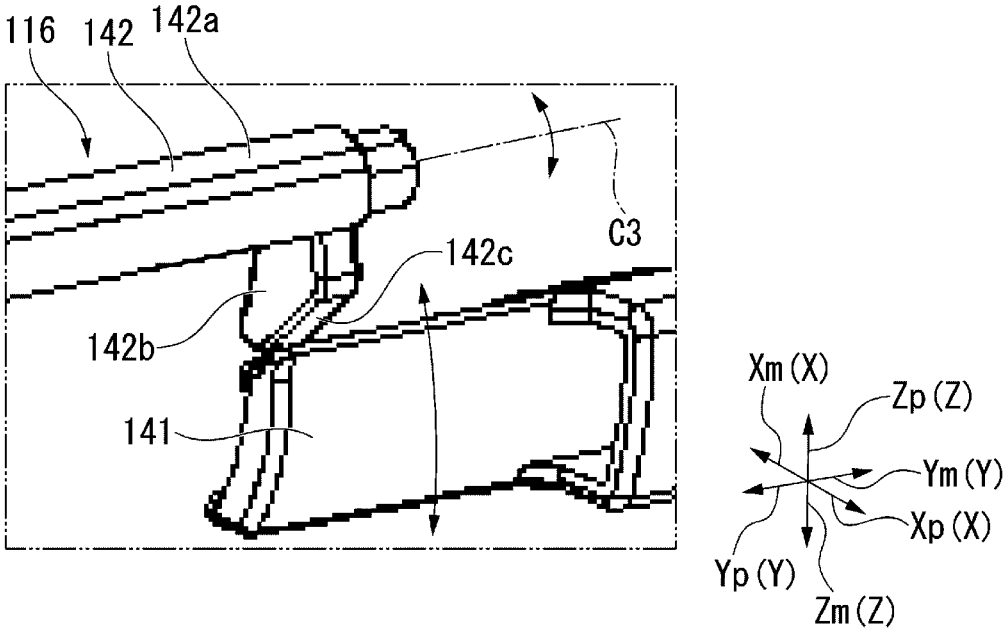
FIG. 6 is an enlarged view of depicting aspects of a sheet conveying device according to a first embodiment.

FIG. 2 is a perspective view of the manual feeding unit 10. FIG. 3 is a perspective view of a part of the manual feeding unit 10. FIG. 4 is a perspective view of another part of the manual feeding unit 10. FIG. 5 is a perspective view of still another part of the manual feeding unit 10. FIG. 6 is a perspective view of an enlarged part of the manual feeding unit 10.

As shown in FIG. 2, the manual feeding tray 12 includes a main body portion 121, a raising and lowering plate 13 ("tray 13"), and a biasing member 14.

The main body portion 121 is formed in a plate shape.

The tray 13 is provided on the main body portion 121. An upper surface of the tray 13 is a surface on which the sheets S are placed. The tray 13 is an example of a tray on which a plurality of sheets S can be stacked.

A supporting portion 123 that is pivotable and supports the tray 13 is provided on the main body portion 121. The supporting portion 123 is disposed on an axis C1. The axis C1 is parallel to the Y direction. The tray 13 is engaged with the supporting portion 123. The tray 13 is pivotable around the axis C1.

As shown in FIG. 1, the raising and lowering mechanism 40 is provided on a device body of the printer unit 3.

With the manual feeding tray 12 in an opened state, the raising and lowering mechanism 40 moves the tray 13 between a raised position and a lowered position by pivoting the tray 13 around the axis C1 (see FIG. 2). The raised position is a position at which a top end of the tray 13 is farthest from the main body portion 121. At the raised position, a sheet on the tray 13 is in contact with (or close to) the pickup roller 112. The lowered position is a position at which the top end of the tray 13 approaches the main body portion 121 most closely. The raising and lowering mechanism 40 may, for example, raise and lower the tray 13 with a driving motor.

As shown in FIG. 3, the holder 114 is rotatable and holds the pickup roller 112. The holder 114 includes an upper plate 114*a*, a first end plate 114*b*, and a second end plate 114*c*. The upper plate 114*a* is formed in a rectangular shape when viewed from the Z direction. A protrusion 114*d* protruding in the Zp direction is formed on an upper surface of the upper plate 114*a*. A top end of a pressing body 131 can abut against the protrusion 114*d*. The holder 114 is pressed at the protrusion 114*d* in a push-down direction by the pressing body 131.

A portion (protrusion 114*d*) where the top end of the pressing body 131 abuts against the holder 114 is on the ZX plane including the pickup roller 112, and overlaps with the pickup roller 112 when viewed from a direction (Z direction) of a biasing force. At least a part of the abutting portion of the pressing body 131 may be on the ZX plane including the pickup roller 112. The abutting portion of the pressing body 131 may overlap with the pickup roller 112 when viewed from the Z direction.

The first end plate 114*b* hangs down from an end portion of the upper plate 114*a* in the Yp direction. The second end plate 114*c* hangs down from an end portion of the upper plate 114*a* in the Ym direction. The first end plate 114*b* and the second end plate 114*c* are along the ZX plane.

The first end plate 114*b* and the second end plate 114*c* are formed with a bearing portion 114*e* that is rotatable and supports a rotary shaft 112A of the pickup roller 112. The rotary shaft 112A of the pickup roller 112 is along the Y direction.

The holder 114 is supported on the device body of the printer unit 3 by a holder shaft 120 along the Y direction. The holder 114 is pivotable around an axis C2 (see FIG. 4) of the holder shaft 120. The holder shaft 120 is located at a position away from the rotary shaft 112A of the pickup roller 112 when viewed from the Y direction. The holder 114 can displace the pickup roller 112 by pivoting around the axis C2 of the holder shaft 120. The holder 114 can change a height position of the pickup roller 112 by pivoting around the axis C2 (see FIGS. 7A and 7B).

As shown in FIGS. 4 and 5, the biasing unit 115 applies a force to the holder 114 in a direction of pushing down the pickup roller 112.

The biasing unit 115 includes the pressing body 131, a biasing member 132, and a supporting portion 133.

As shown in FIG. 5, the pressing body 131 includes a main body portion 131*a* and a flange portion 131*b*. The pressing body 131 is displaceable in a length direction of the main body portion 131*a*. The main body portion 131*a* is formed in a rod shape elongated in the Z direction. The main body portion 131*a* is inserted into the biasing member 132.

The flange portion 131*b* protrudes outward in a radial direction of the main body portion 131*a* at an intermediate portion of the main body portion 131*a* along the length direction. The flange portion 131*b* is formed in a plate shape perpendicular to the length direction of the main body portion 131*a*. The flange portion 131*b* is engageable with a lower end of the biasing member 132.

The biasing member 132 is inserted into the main body portion 131*a*. The lower end of the biasing member 132 is engaged with an upper surface of the flange portion 131*b*. The biasing member 132 is, for example, a coil spring. The biasing member 132 applies a force to the flange portion 131*b* in a direction of approaching the holder 114. The pressing body 131 is biased in the direction of approaching the holder 114.

As shown in FIG. 4, the supporting portion 133 includes a base board 133*a*, a first engagement portion 133*b*, and a second engagement portion 133*c*. The base board 133*a* is formed in a plate shape along the YZ plane. The first engagement portion 133*b* is formed in a plate shape along the XY plane. The flange portion 131*b* of the pressing body 131 is engageable with an upper surface of the first engagement portion 133*b*.

The second engagement portion 133*c* is located at a position separated from the first engagement portion 133*b* in the Zp direction. The second engagement portion 133*c* is formed in a plate shape along the XY plane. An upper end of the biasing member 132 is engageable with a lower surface of the second engagement portion 133*c*. The biasing member 132 takes a reaction force to the second engagement portion 133*c* and applies the force to the flange portion 131*b* in the direction of approaching the holder 114.

As shown in FIG. 5, the tray up detecting mechanism 116 includes an operation unit 141, an actuator 142, a detection unit 143, and a sensor 144. The tray up detecting mechanism 116 is one example of a "detecting mechanism". The tray up detecting mechanism 116 detects that the sheets S push up the pickup roller 112.

The operation unit 141 extends in the Yp direction from an outer surface of the first end plate 114*b* (the surface facing the Yp direction). The operation unit 141 is formed in a long plate shape elongated in the Yp direction. For example, the operation unit 141 is curved around the axis C2 of the holder shaft 120 (see FIG. 4).

As shown in FIG. 6, the actuator 142 includes a shaft portion 142*a* and a cam plate portion 142*b*. The shaft portion 142*a* is elongated in the Y direction. The actuator 142 is pivotable around an axis C3 of the shaft portion 142*a*.

The cam plate portion 142*b* protrudes outward in a radial direction of the shaft portion 142*a* from an outer peripheral surface of the shaft portion 142*a*. The cam plate portion 142*b* is formed in a plate shape perpendicular to the length direction of the shaft portion 142*a*. An outer surface of the cam plate portion 142*b* is a cam surface 142*c*.

As shown in FIG. 5, the detection unit 143 protrudes outward in the radial direction of the shaft portion 142*a* from the outer peripheral surface of the shaft portion 142*a*. The detection unit 143 is formed in a plate shape perpendicular to the length direction of the shaft portion 142*a*. The detection unit 143 pivots in the same direction as that of the actuator 142 in conjunction with the actuator 142. The detection unit 143 is switchable between a reference position and a detection position by pivoting in conjunction with the actuator 142.

For example, a photo-interrupter is used as the sensor 144. The sensor 144 includes a light-emitting unit 144*a* and a light-receiving unit 144*b*. The light-emitting unit 144*a* and the light-receiving unit 144*b* face each other. When the detection unit 143 is at the reference position, the detection unit 143 does not block light from the sensor 144. When the detection unit 143 pivots together with the actuator 142 and reaches the detection position, the detection unit 143 blocks the light. When the light is blocked, the sensor 144 sends a detection signal to the control circuit 60 (see FIG. 1).

Next, operations of the image processing apparatus 100 will be described. First, a print operation will be described.

In the image processing apparatus 100, conditions (settings) such as the type of sheets S on which an image is to be formed and the number of sheets to be printed can be set based on user operations at the control panel 1 or by an external signal. Image formation is started according to a print start signal. Image information (print data) is sent to the printer unit 3 by the scanner unit 2 reading an object to be copied or from the outside. The printer unit 3 supplies the sheets S from the sheet feeding unit 4 or the manual feeding unit 10 to the registration rollers 24 based on a control signal generated by the control circuit 60 in response to the condition settings and the reception of the print start signal. A case where the sheets S are fed from the manual feeding unit 10 will be described.

When the print start signal is received, the control circuit 60 performs control to start sheet feeding from the manual feeding unit 10 for the image formation.

Each image forming unit 25 forms an electrostatic latent image on the respective photosensitive drum 7 based on image information corresponding to each color. The electrostatic latent image is developed by the developing device 8. Therefore, a toner image corresponding to the electrostatic latent image is formed on the surface of each photosensitive drum 7.

Each toner image is transferred to the intermediate transferring belt 27 by the respective transfer roller. As the intermediate transferring belt 27 moves, the toner images are sequentially superimposed on one another without causing a color shift, and these superimposed toner images are sent to the transferring unit 28.

The sheet S is fed from the registration rollers 24 to the transferring unit 28 to meet the toner image to be transferred. The toner images that reach the transferring unit 28 are transferred to the sheet S. The transferred toner images are fixed to the sheet S by the fixing device 29. Images are thus formed on the sheet S (a sheet S has been printed).

Next, an operation of the manual feeding unit 10 will be described.

The user places sheets S on the tray 13 (see FIG. 2) of the manual feeding tray 12 (see FIG. 1). The number of sheets S placed on the tray 13 corresponds to the total number of sheets S the user wishes to be printed.

When the tray 13 (see FIG. 2) reaches the raised position, the sheets S placed on the tray 13 come into contact with the pickup roller 112 (see FIG. 3) and a force from the sheets S is applied in a push-up direction to the pickup roller 112.

Figure 7B:
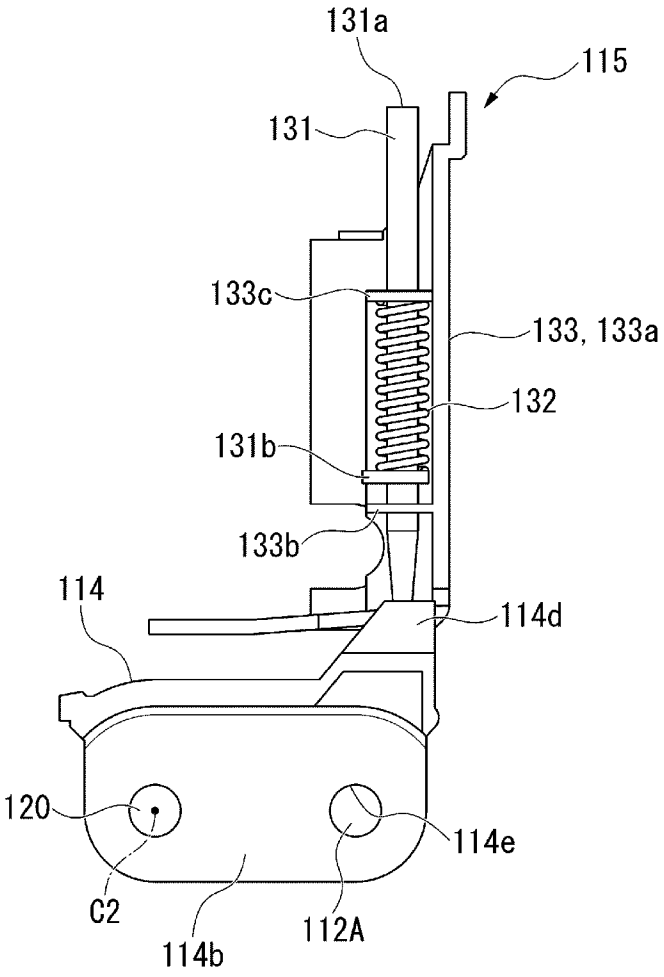
FIGS. 7A and 7B depict aspects related to an operation of a sheet conveying device according to a first embodiment.
Figure 7A:
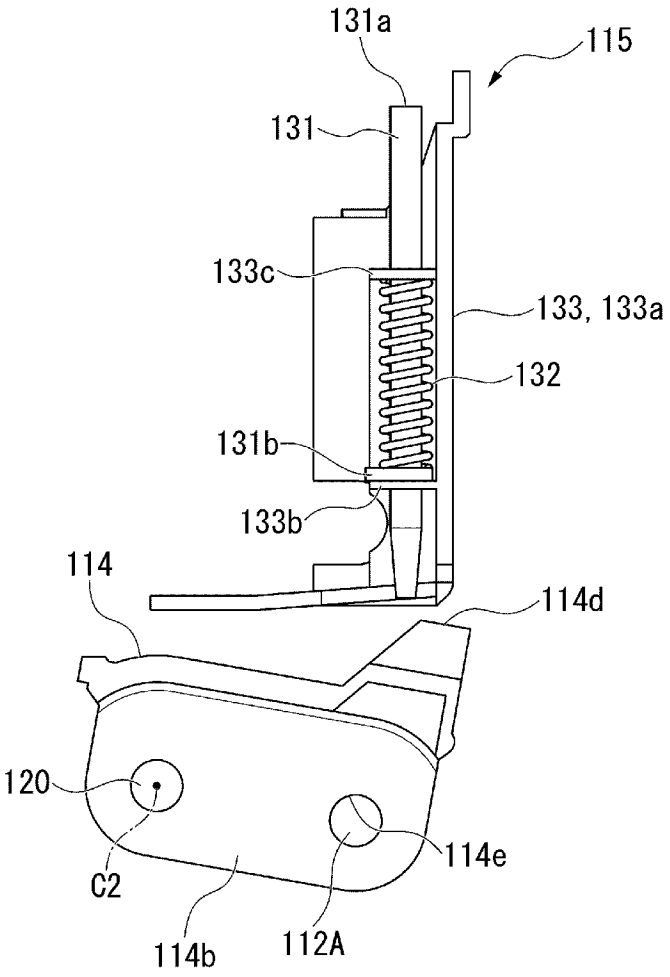

As shown in FIGS. 7A and 7B, when the pickup roller 112 (see FIG. 5) is pushed up, the holder 114 pivots around the axis C2 of the holder shaft 120, and the protrusion 114*d* pushes up the pressing body 131. When the pressing body 131 is pushed up, the biasing member 132 is compressed. The pressing body 131 applies a force to the holder 114 in a push-down direction by an elastic force of the biasing member 132.

As shown in FIG. 5, when the holder 114 pivots around the axis C2 of the holder shaft 120, the operation unit 141 also pivots around the axis C2. As shown in FIG. 6, the operation unit 141 is in contact with the cam surface 142*c* of the cam plate portion 142*b* and pivots the actuator 142 around the axis C3.

The detection unit 143 pivots together with the actuator 142 and moves from the reference position to the detection position.

When the detection unit 143 reaches the detection position, the detection unit 143 blocks the detection light of the sensor 144. The sensor 144 detects that the detection unit 143 reaches the detection position. The sensor 144 sends a detection signal to the control circuit 60 (see FIG. 1). The control circuit 60 then sends control signals to each component of the image processing apparatus 100 to convey the sheet S from the manual feeding tray 12 to the conveying unit 5, and performs the print operation described above.

Figure 8:
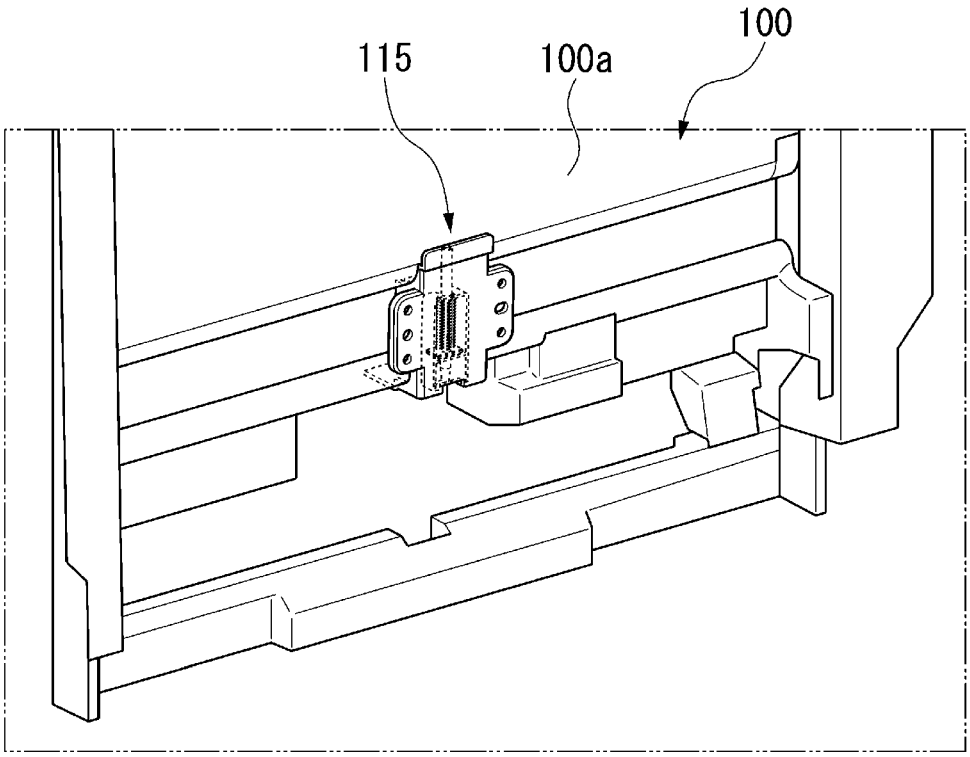
FIG. 8 is a perspective view of a portion of an image processing apparatus to which a biasing unit is attached.
Figure 9:
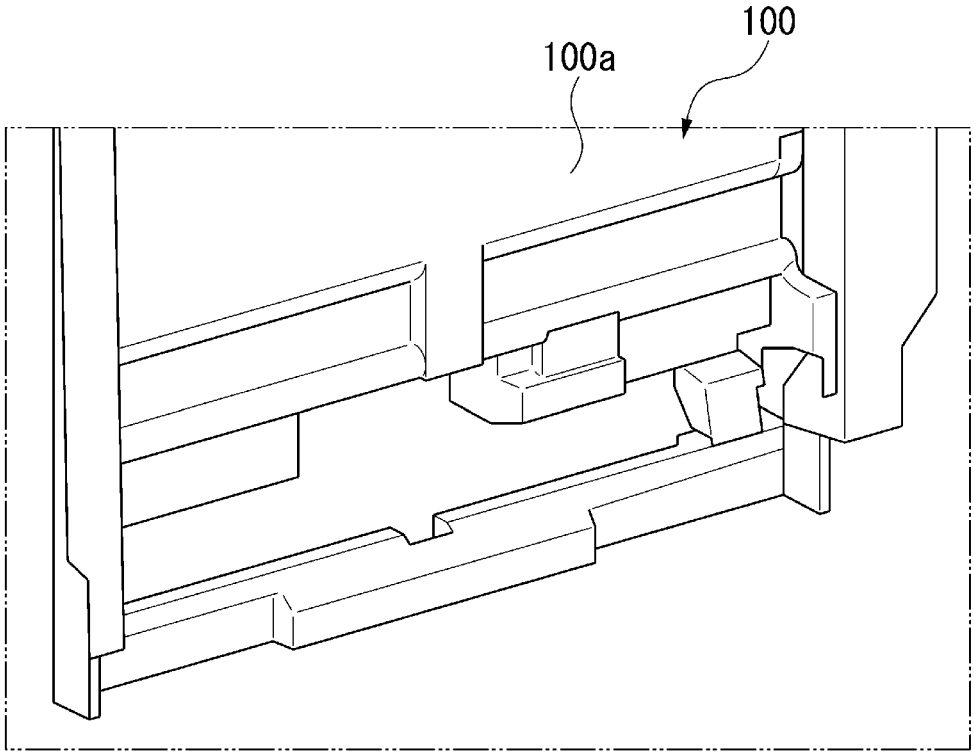
FIG. 9 is a perspective view of a portion of an image processing apparatus from which a biasing unit has been detached.

FIG. 8 is a perspective view of an apparatus body 100*a* of the image processing apparatus 100 to which the biasing unit 115 is attached. FIG. 9 is a perspective view of the apparatus body 100*a* from which the biasing unit 115 has been detached.

As shown in FIG. 8, the biasing unit 115 is attachable to the apparatus body 100*a*. As shown in FIG. 9, the biasing unit 115 may be detachable from the apparatus body 100*a* in some examples. When the biasing unit 115 is attachable to and detachable from the apparatus body 100*a*, maintenance may be easier. When the biasing unit 115 is attachable to and detachable from the apparatus body 100*a*, a specification for the manual feeding unit 10 is more easily changed by replacing of the biasing member 132 or the like.

In the manual feeding unit 10, since the biasing unit 115 applies the biasing force to the holder 114 on the ZX plane including the pickup roller 112, a structure of the manual feeding unit 10 can be simplified as compared with that when a biasing unit is more separated from a pickup roller. In addition, since the biasing unit 115 applies the biasing force to the holder 114 at the position of overlapping the pickup roller 112 when viewed from the direction (Z direction) of the biasing force, the structure of the manual feeding unit 10 can be simplified as compared with that when the biasing unit is more separated from the pickup roller. Since the manual feeding unit 10 has a simpler structure, the manual feeding unit 10 is advantageous in terms of size reduction and space-saving.

Since the biasing unit 115 applies the biasing force to the holder 114 on the ZX plane including the pickup roller 112, a pressing force of the pressing body 131 is efficiently transmitted to the pickup roller 112. In addition, since the biasing force is applied to the holder 114 at the position of overlapping the pickup roller 112 when viewed from the direction (Z direction) of the biasing force, the pressing force by the pressing body 131 is efficiently transmitted to the pickup roller 112.

The tray up detecting mechanism 116 includes the operation unit 141 and the actuator 142. The actuator 142 can switch between the reference position and the detection position of the detection unit 143. Since the detection unit 143 is switched between the reference position and the detection position by an operation of the actuator 142, the detection unit 143 can reliably operate and an erroneous operation can be prevented.

Since the detection unit 143 is provided on the shaft portion 142*a* of the actuator 142, the detection unit 143 can reliably operate.

The biasing unit 115 includes the pressing body 131, the biasing member 132, and the supporting portion 133. Since a structure of the biasing unit 115 is simple, miniaturization of the biasing unit 115 can be achieved.

Second Embodiment

Figure 10:
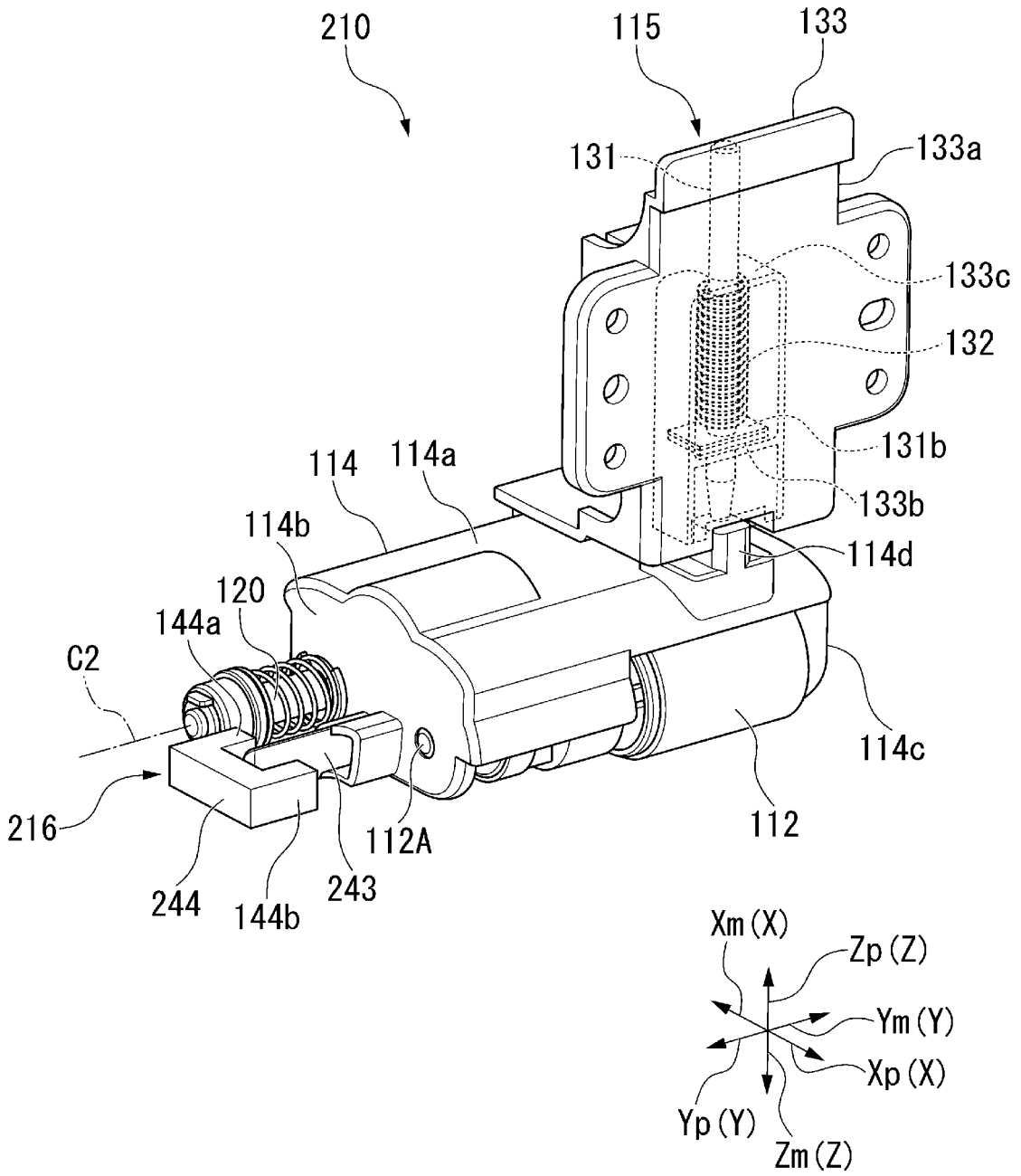
FIG. 10 is a perspective view of a part of a sheet conveying device according to a second embodiment.

FIG. 10 is a perspective view of a part of the sheet conveying device according to the second embodiment.

As shown in FIG. 10, a manual feeding unit 210 includes a tray up detecting mechanism 216 instead of the tray up detecting mechanism 116.

The tray up detecting mechanism 216 includes a detection unit 243 and a sensor 244. The tray up detecting mechanism 216 is one example of a "detecting mechanism".

The detection unit 243 has a similar configuration to that of the operation unit 141 (see FIG. 3) in the manual feeding unit 10 according to the first embodiment. When the holder 114 pivots around the axis C2, the detection unit 243 also pivots around the axis C2.

For example, the sensor 244 is a photo-interrupter including the light-emitting unit 144*a* and the light-receiving unit 144*b*.

Figure 11B:
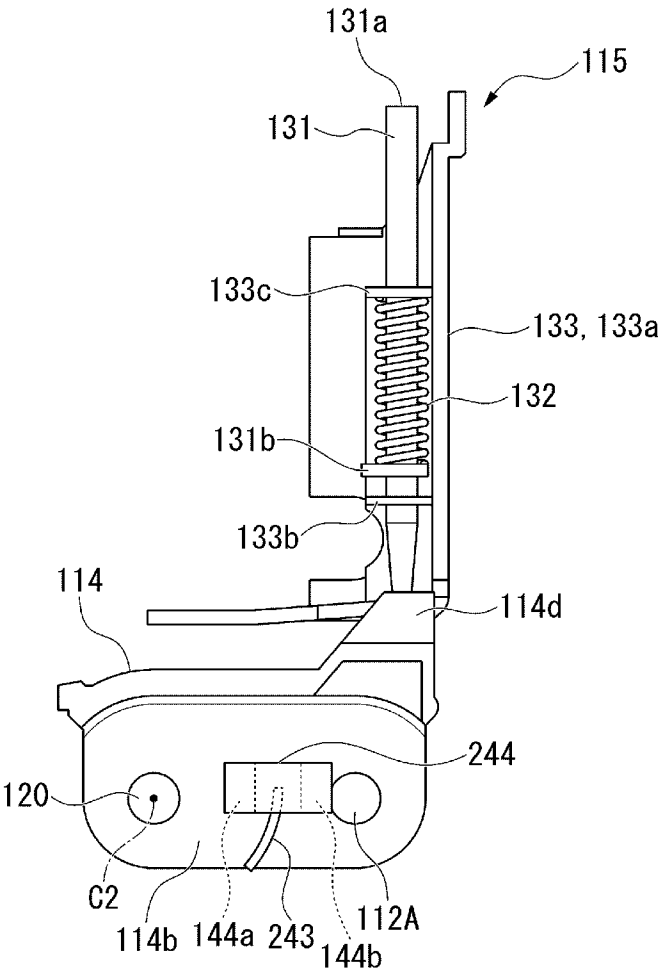
FIGS. 11A and 11B depict aspects related to an operation of a sheet conveying device according to a second embodiment.
Figure 11A:
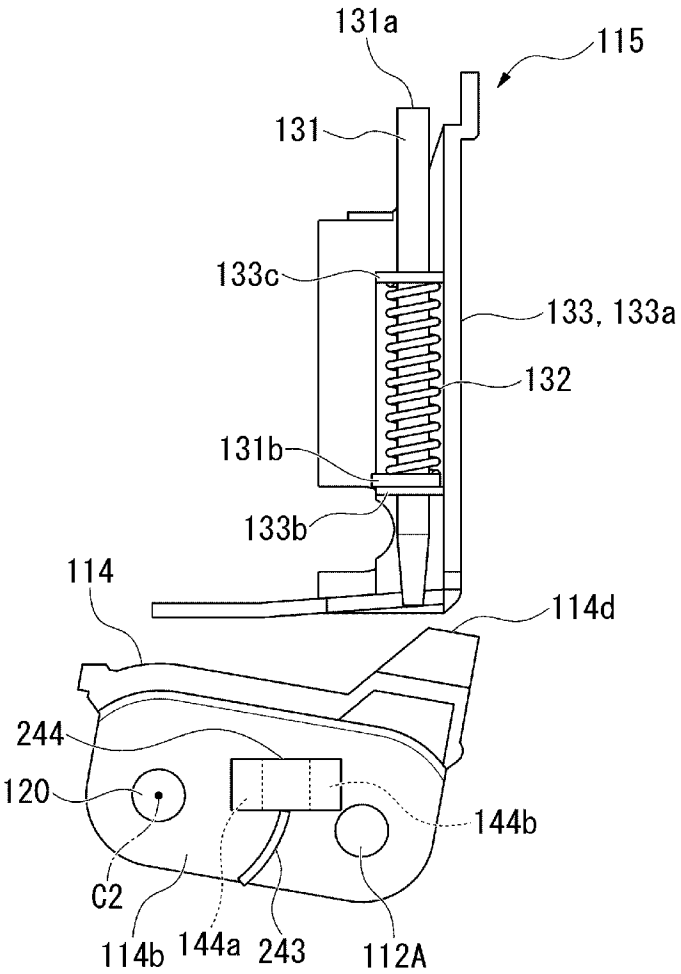

As shown in FIGS. 11A and 11B, when the pickup roller 112 (see FIG. 10) is pushed up, the holder 114 pivots around the axis C2 of the holder shaft 120, and the protrusion 114*d* pushes up the pressing body 131. The pressing body 131 applies a force to the holder 114 in a push-down direction by the biasing member 132.

As the holder 114 pivots around the C2, the detection unit 243 also pivots around the axis C2. The detection unit 243 moves from a reference position to a detection position. When the detection unit 243 reaches the detection position, the detection unit 243 blocks light from the sensor 244. The sensor 244 sends a detection signal to the control circuit 60 (see FIG. 1). The control circuit 60 sends control signals to each component of the image processing apparatus 100 to convey the sheet S from the manual feeding tray 12 to the conveying unit 5, and performs the print operation.

The manual feeding unit 210 includes fewer components for the tray up detecting mechanism 216 and has a simpler structure. Since the manual feeding unit 210 has a simple structure, the manual feeding unit 210 is advantageous in terms of size reduction and space-saving.

Third Embodiment

Figure 12:
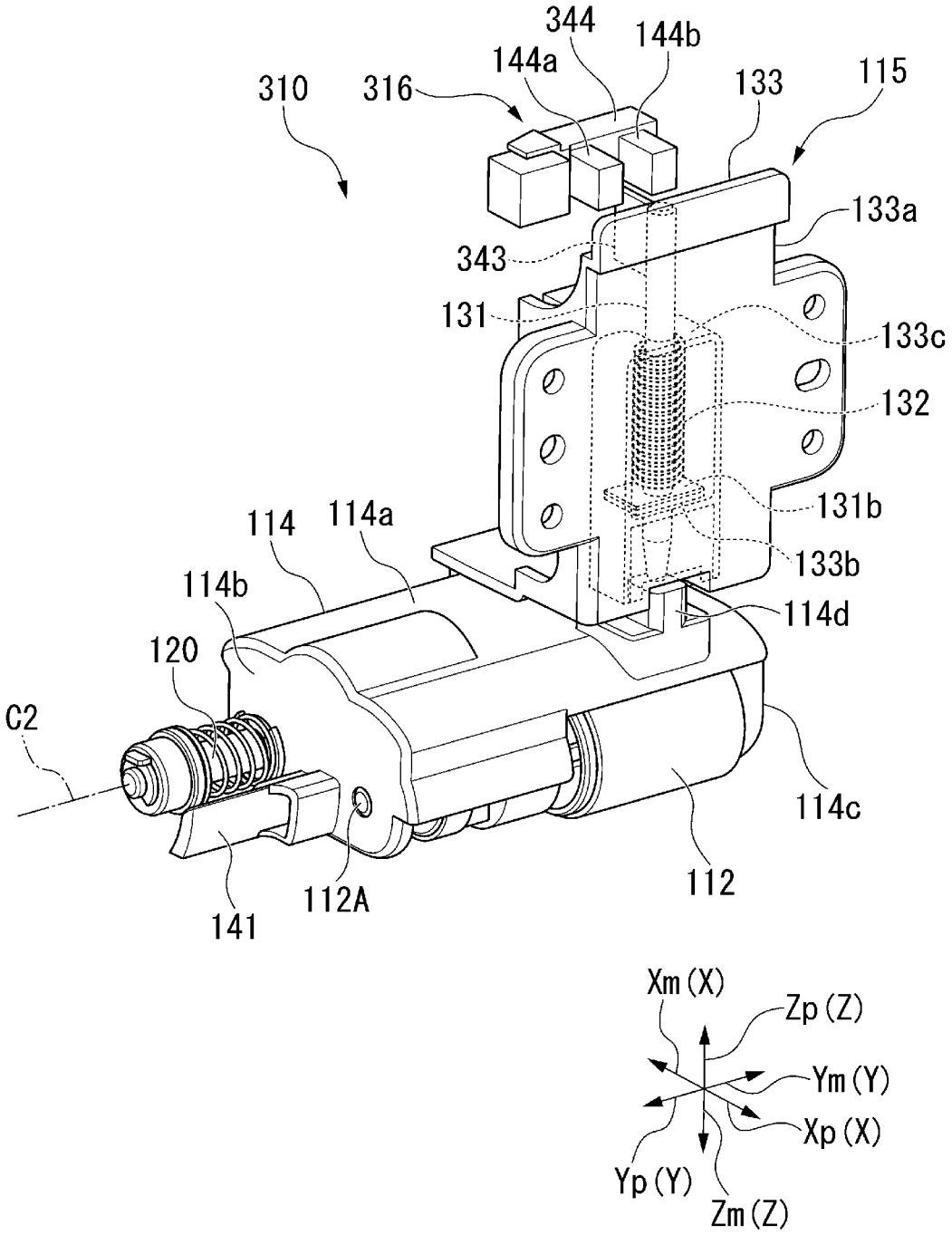
FIG. 12 is a perspective view depicting aspects of a sheet conveying device according to a third embodiment.

FIG. 12 is a perspective view of a sheet conveying device according to a third embodiment.

As shown in FIG. 12, a manual feeding unit 310 includes a tray up detecting mechanism 316 instead of the tray up detecting mechanism 116.

The tray up detecting mechanism 316 includes a detection unit 343 and a sensor 344. The tray up detecting mechanism 316 is one example of a "detecting mechanism".

The detection unit 343 is provided on an upper end portion of the pressing body 131. The detection unit 343 is formed in a plate shape along the ZX plane. The detection unit 343 protrudes outward in a radial direction from an outer peripheral surface of the main body portion 131*a*. The detection unit 343 moves up and down together with the pressing body 131.

For example, the sensor 344 is a photo-interrupter including the light-emitting unit 144*a* and the light-receiving unit 144*b*.

Figure 13B:
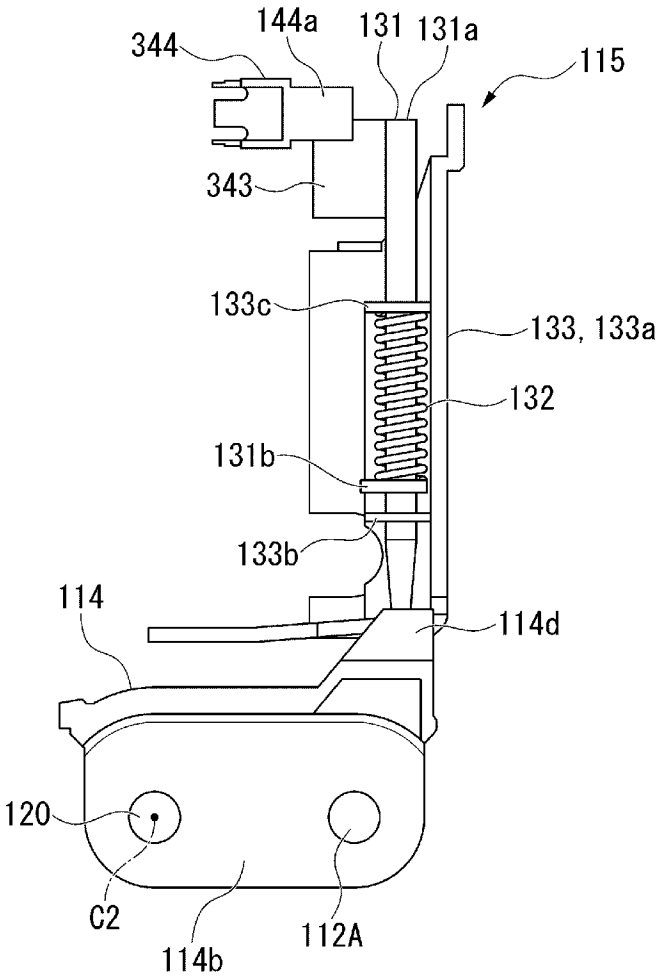
FIGS. 13A and 13B depict aspects related to an operation of a sheet conveying device according to a third embodiment.
Figure 13A:
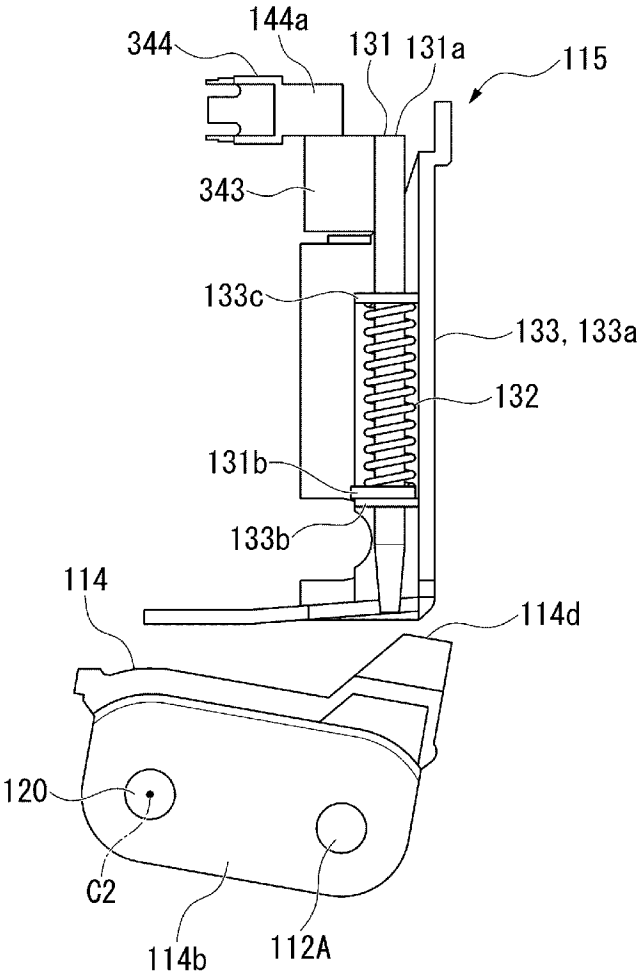

As shown in FIGS. 13A and 13B, when the pickup roller 112 is pushed up, the holder 114 pivots around the axis C2 of the holder shaft 120, and the protrusion 114*d* pushes up the pressing body 131. The pressing body 131 applies a force to the holder 114 in a push-down direction by the biasing member 132.

By raising the pressing body 131, the detection unit 343 moves from a reference position to a detection position. When the detection unit 343 reaches the detection position, the detection unit 343 blocks light from the sensor 344. The sensor 344 sends a detection signal to the control circuit 60 (see FIG. 1). The control circuit 60 sends control signals to each component of the image processing apparatus 100 to convey the sheet S from the manual feeding tray 12 to the conveying unit 5, and performs a print operation.

Since the manual feeding unit 310 is at a position at which the detection unit 343 and the sensor 344 are close to the holder 114, a reduction of a size of the manual feeding unit 310 can be achieved.

According to at least one embodiment described above, a biasing unit applies a biasing force to a holder on the plane that is parallel to the direction of the biasing force and includes the pickup roller, and thus a structure of the sheet conveying device can be simplified. Since the sheet conveying device has a simple structure, the sheet conveying device is advantageous in terms of size reduction and space-saving. In addition, according to at least one embodiment described above, the biasing unit applies the biasing force to the holder at the position of overlapping the pickup roller when viewed from the direction of the biasing force, and thus the structure of the sheet conveying device can be simplified. Since the sheet conveying device has a simple structure, the sheet conveying device is advantageous in terms of size reduction and space-saving.

While certain embodiments have been described, the embodiments have been presented by way of examples only, and are not intended to limit the scope of the disclosure. These embodiments can be implemented in other various forms, and various omissions, replacements, and changes can be made without departing from the spirit of the disclosure. These embodiments and modifications thereof fall within the scope and spirit of the invention and are included in the scope of the invention recited in the claims and the equivalent thereof.

What is claimed is:

1. A sheet conveying device, comprising:

a tray on which sheets can be stacked;

a pickup roller configured to convey sheets from the tray to a sheet conveyance path;

a movement mechanism configured to move the tray between a raised position at which sheets on the tray come into contact with the pickup roller and a lowered position that is lower than the raised position;

a holder configured to hold the pickup roller such that the pickup roller displaces upward when pushed up by sheets on the tray;

a biasing unit configured to apply a biasing force to the holder in a direction pushing the pickup roller downward towards the tray; and a detecting mechanism configured to detect when the pickup roller is displaced upward by the sheets on the tray and including:

a detection unit that moves between a reference position and a detection position according to displacement of the holder upwards or downwards;

an operation unit protruding from the holder; and a sensor configured to detect the detection unit at the detection position, wherein the detection unit comprises an actuator that operates by movement of the operation unit accompanying the displacement of the holder to switch between the reference position and the detection position.

2. The sheet conveying device according to claim 1, wherein the biasing unit applies the biasing force to the holder at a position of overlapping the pickup roller when viewed from the direction in which the biasing force is applied.

3. The sheet conveying device according to claim 1, wherein the actuator comprises a shaft portion that is pivotable around an axis, and the detection unit protrudes from an outer peripheral surface of the shaft portion.

4. The sheet conveying device according to claim 1, wherein the biasing unit comprises:

a pressing body configured to apply the biasing force to the holder;

a biasing member configured to bias the pressing body in a direction towards the holder; and a supporting portion configured to support the pressing body and the biasing member.

5. The sheet conveying device according to claim 4, wherein the biasing member comprises a spring.

6. The sheet conveying device according to claim 1, wherein the sensor is a light sensor.

7. The sheet conveying device according to claim 1, wherein the movement mechanism comprises a driving motor.

8. The sheet conveying device according to claim 1, wherein the biasing unit is attachable to and detachable from an apparatus body of an image processing apparatus.

9. An image forming device, comprising:

a housing;

an image forming unit in the housing and configured to form an image on a sheet;

a conveyance path configured to convey the sheet to image forming unit for an image to be formed thereon; and a manual feed device mounted to the housing and configured to provide the sheet to the conveyance path for conveyance of the sheet to the image forming unit, the manual feed device including:

a tray on which sheets can be stacked;

a pickup roller configured to convey sheets from the tray to the conveyance path;

a movement mechanism configured to move the tray between a raised position at which sheets on the tray come into contact with the pickup roller and a lowered position that is lower than the raised position;

a holder configured to hold the pickup roller such that the pickup roller displaces upward when pushed up by sheets on the tray;

a biasing unit configured to apply a biasing force to the holder in a direction pushing the pickup roller downward towards the tray; and a detecting mechanism configured to detect when the pickup roller is displaced upward by the sheets on the tray and including:

a detection unit that moves between a reference position and a detection position according to displacement of the holder upwards or downwards;

an operation unit protruding from the holder; and a sensor configured to detect the detection unit at the detection position, wherein the detection unit comprises an actuator that operates by movement of the operation unit accompanying the displacement of the holder to switch between the reference position and the detection position.

10. The image forming device according to claim 9, wherein the biasing unit applies the biasing force to the holder at a position of overlapping the pickup roller when viewed from the direction in which the biasing force is applied.

11. The image forming device according to claim 9, wherein the actuator comprises a shaft portion that is pivotable around an axis, and the detection unit protrudes from an outer peripheral surface of the shaft portion.

12. The image forming device according to claim 9, wherein the biasing unit comprises:

a pressing body configured to apply the biasing force to the holder;

a biasing member configured to bias the pressing body in a direction towards the holder; and a supporting portion configured to support the pressing body and the biasing member.

13. The image forming device according to claim 12, wherein the biasing member comprises a spring.

14. The image forming device according to claim 9, wherein the sensor is a light sensor.

15. The image forming device according to claim 9, wherein the movement mechanism comprises a driving motor.

16. The image forming device according to claim 9, wherein the biasing unit is detachably attached to an outer surface of the housing.

17. The image forming device according to claim 9, wherein the tray rotates to face against the housing.

* * * * *